US006246167B1

(12) United States Patent
Sica

(10) Patent No.: US 6,246,167 B1
(45) Date of Patent: Jun. 12, 2001

(54) U-SHAPED FLUORESCENT LAMP WITH PROTECTIVE ASSEMBLY

(76) Inventor: Michael F. Sica, 261 Round Hill Rd., Greenwich, CT (US) 06831

( * ) Notice: Subject to any disclaimer, the term of this patent is extended or adjusted under 35 U.S.C. 154(b) by 0 days.

(21) Appl. No.: 09/343,008

(22) Filed: Jun. 29, 1999

(51) Int. Cl.[7] ..... H01J 17/18

(52) U.S. Cl. ..... 313/493; 313/634; 313/110

(58) Field of Search ..... 313/493, 634, 313/25, 238, 110, 116, 324, 483, 484, 485, 625, 624; 362/223, 224, 332, 361, 351

(56) References Cited

U.S. PATENT DOCUMENTS

| | | | | |
|---|---|---|---|---|
| 2,135,696 | | 11/1938 | Baumhauer et al. . | |
| 2,363,109 | | 11/1944 | Keiffer . | |
| 2,581,959 | | 1/1952 | Koehler . | |
| 3,358,167 | | 12/1967 | Shanks . | |
| 3,453,470 | | 7/1969 | Hammer . | |
| 3,602,759 | | 8/1971 | Evans | 313/110 |
| 3,720,826 | | 3/1973 | Gilmore et al. | 313/25 |
| 3,805,065 | * | 4/1974 | Williams | 350/96.23 |
| 3,808,495 | | 4/1974 | Win | 313/110 |
| 4,048,537 | | 9/1977 | Blaisdell et al. | 313/489 |
| 4,916,352 | | 4/1990 | Haim et al. | 313/25 |
| 4,924,368 | | 5/1990 | Northrop et al. | 362/376 |
| 5,173,637 | | 12/1992 | Sica | 313/634 |
| 5,452,188 | * | 9/1995 | Green et al. | 362/227 |
| 5,536,998 | | 7/1996 | Sica | 313/489 |
| 5,729,085 | | 3/1998 | Sica et al. | 313/493 |
| 6,043,600 | * | 3/2000 | Sica | 313/493 |

FOREIGN PATENT DOCUMENTS

| | | |
|---|---|---|
| 2 642 397 | 8/1990 | (FR) . |
| 61-107653 | 5/1986 | (JP) . |
| 1-169864 | 7/1989 | (JP) . |

* cited by examiner

*Primary Examiner*—Nimeshkumar D. Patel
*Assistant Examiner*—Joseph Williams
(74) *Attorney, Agent, or Firm*—Baker Botts L.L.P.

(57) ABSTRACT

A U-shaped fluorescent lamp has a protective assembly that includes a two-part loop unit and a pair of leg units. Each loop part is formed of a transparent or translucent non-frangible polymeric material, is semi-cylindrical in cross section and is shaped in plan to match the shape in plan of the loop portion of the glass tube of the lamp. The loop parts are coextensive, engage each other along mating edges at a tongue and groove joint, and are joined to each other along the mating edges solely by mechanical couplings. Each leg unit is a straight tube of a transparent or translucent non-frangible polymeric material, is cylindrical in cross section, and is joined at one end to one end of the loop unit by a telescopic joint in which the end portion of the straight tube receives a cylindrical end portion of the loop unit and is joined at the other end to the terminal end cap of the lamp by a joint that includes an adhesive.

20 Claims, 2 Drawing Sheets

U-SHAPED FLUORESCENT LAMP WITH PROTECTIVE ASSEMBLY

BACKGROUND OF THE INVENTION

When fluorescent lamps break, fragments of the glass tube and powders from the phosphor coating inside the lamp are scattered about. In places where food is processed or stored, and particularly in food-processing plants and lighted display cabinets in supermarkets where stocking clerks and customers handle food in proximity to the cabinet lamps, it is at least highly desirable, and is often required by government regulations, that the lamps be protected in a way that minimizes the possibility of the lamps being broken and if they do break the possibility of glass fragments and phosphor powders escaping and contaminating the food. Fluorescent lamps with protective assemblies are known and widely used for this purpose. Fluorescent lamps with protective assemblies are also desirable in industrial settings and in various places in residences, such as kitchen, shops and garages. Examples of such lamps are those described and shown in U.S. Pat. Nos. 3,453,470 (Hammer, Jul. 1, 1969); 3,602,759 (Evans, Aug. 31, 1971); 3,720,826 (Gilmore et al., Mar. 13, 1973); 3,808,495 (Win, Apr. 30, 1974); 4,048,537 (Blaisdell et al., 1977); 4,924,368 (Northrup et al., 1990); 5,173,637 (Sica, 1992); 5,536,998 (Sica, 1994); and 5,729,085 (Sica, 1998). The Sica patents are owned by the assignee of the present invention.

In most instances, the prior art protective assemblies for fluorescent lamps include special molded end fittings that fit onto the terminal caps of the lamp and hold a protective sleeve in place on the lamp. In some cases, the end fittings are intentionally designed so that they can be removed from the lamp, thus allowing the protective assembly to be reused as lamps burn out and are replaced. Removable protective assemblies do not fully ensure that glass fragments and phosphor powders are retained in case the lamp breaks, inasmuch as the removable end fitting can be dislodged from the lamp and the protective sleeve if the lamp breaks. Regardless of whether the end fittings are permanently attached to the lamp or are removable, they are relatively expensive and usually have to be designed for a specific lamp style to ensure a proper fit.

The protective assemblies of the Sica '637 and '998 patents referred to above consist of a protective tube extruded from a polycarbonate resin that is stabilized against ultraviolet radiation and a collar at each end that is shrink-fitted over the flange portion of the respective terminal cap and over an end portion of the protective sleeve. Each collar is bonded to both the terminal cap and the protective sleeve to ensure that the terminal caps, collars and protective sleeve remain intact should the glass tube of the lamp break. The protected lamp of the Sica '085 patent also has a protective tube extruded from a polycarbonate resin that is stabilized against ultraviolet radiation. Each end of the tube is formed by thermal and mechanical compression working to provide a necked down end portion. The necked down end portions are secured to the terminal caps of the fluorescent lamp by an adhesive, preferably by a double-faced contact adhesive tape. The lamps of the Sica patents provide excellent protection against breakage of the lamp, and if the lamp should break, the protective assembly provides an enclosure for the lamp glass tube and terminal caps that is secure against separation, thus preventing release and scattering of glass fragments and phosphor powders. The Sica lamps are relatively inexpensive to produce, inasmuch as they use simple tubular elements and commercially available adhesive tapes and are easily and quickly assembled.

WO 99/12186 (published Mar. 11, 1999, Sica) describes and shows curved fluorescent lamps, such as U-shaped lamps, that are protected by two-part sleeves, each part being injection-molded to a shape in plan that corresponds to the shape of the lamp and to a semi-cylindrical cross-section from a polycarbonate resin that is highly stabilized against ultraviolet radiation. Each part has a flange along each edge, and the flanges of the two parts mate and are joined by fusion bonding, chemical bonding or adhesive bonding. Each end of the protective sleeve is sealed and adhered to the terminal cap of the lamp by a shrink-fit collar and an adhesive (see Sica '637 and '998 patents referred to above) or by a thermally/mechanically formed necked down portion and an adhesive (see Sica '085 patent referred to above).

In order to fit over an entire lamp, the two parts of the protective sleeve of WO 99/12186 are of large size, thus requiring very expensive molds. Similarly, the very long lengths of the mating flanges make it difficult to join the flanges, regardless of the type of joints.

BRIEF SUMMARY OF THE INVENTION

An object of the present invention is to provide a U-shaped fluorescent lamp in which the glass tube or envelope of the fluorescent lamp component is protected from impacts and thus from being broken. Yet another object is to prevent scattering of glass fragments, phosphor powders, and mercury in the environment in the event that the glass tube of the fluorescent lamp is shattered or broken. Still another object is to minimize the size of injection-molded parts, thus reducing the costs of the molds, reducing the lengths of joints between molded parts, and facilitating joining the injection-molded parts.

The foregoing objects are attained, in accordance with the present invention, by a lamp assembly that includes a U-shaped fluorescent lamp having a U-shaped glass tube that includes a loop portion and a pair of straight leg portions integral with the loop portion and a terminal end cap joined to a free end of each leg portion. The lamp of the lamp assembly is of conventional construction and is widely available commercially. The lamp is enclosed in and protected by a protective assembly having a loop unit and a pair of leg units. The loop unit is composed of a pair of loop parts, each loop part being formed of a transparent or translucent non-frangible polymeric material and being semi-cylindrical in cross-section and shaped in plan to match the shape in plan of the loop portion of the glass tube of the lamp. The loop parts are coextensive and engage each other along mating edges and are joined to each other along the edges. Each leg unit is a straight tube of a transparent or translucent non-frangible polymeric material of cylindrical cross section and is joined at one end to one end of the loop unit and at the other end to the terminal end cap of the lamp.

The construction of the protective assembly from two molded loop parts and two straight parts allows the loop parts to be relatively small, which permits the use of a much smaller, lower cost mold to produce them. The smaller loop unit also facilitates joinder of the two parts, the lengths of the joints between the two parts being much less than those of a protective assembly made of two half parts that are joined to cover the entire lamp (see WO 99/12186 referred to above). A protected lamp according to the present invention is also attractive in appearance, the joints of the loop unit being relatively unobtrusive and the straight parts being free of joints along their lengths.

In a preferred embodiment, the edges of the loop parts are joined to each other by mechanical couplings, such as a Ad plurality of snap-fit couplings. Each coupling may consist of a lug on one loop part, the lug having a slot, and a hook on the other loop part, the hook being received through the slot and having a shoulder engaged in capturing relation with a portion of the lug adjacent the slot. Mechanical snap-fit couplings make assembly of the loop unit quick and easy—assembly can be done by hand, no tools being required.

Each straight tube is, to advantage, joined to the loop unit by a telescopic joint between an end portion of the loop unit that is cylindrical in cross section and an end portion of the straight tube. It is desirable for the end portion of the straight tube to telescopically receive the end portion of the loop unit within it—the unitary end of the straight tube captures the end of the two-part loop unit and helps hold the two loop parts firmly together. It is also possible to have the telescopic joint formed solely by an interference fit between the end portion of the straight tube and the end portion of the loop unit—the use of an adhesive at the joints between the loop unit and the straight tubes, though not ruled out, is to be avoided if possible. The end portion of the loop unit may have a tapered external surface to facilitate reception of the end portion of the straight tube. Also, forming a beveled end surface on each end of the loop unit aids in starting the end portion of the tube over the end portion of the loop unit upon assembly.

Other desirable characteristics of the protective assembly, according to the present invention, include (1) having the mating edges of the loop parts interfit by a tongue and groove joint; (2) joining the free end of each straight tube to the terminal end cap of the lamp by an adhesive bond between a necked down end portion of the straight tube and the terminal end cap, the necked down portion being formed by heating and mechanically compressing the end portion in situ; and (3) providing the adhesive bond by wrapping a length of double-faced adhesive tape around the terminal end cap of the lamp before the straight tube is placed over the lamp. The latter two features are known per se from the Sica '850 patent, which is incorporated into the present specification for all purposes.

DESCRIPTION OF THE DRAWINGS

For a more complete understanding of the present invention, and the advantages thereof, reference may be made to the following written description of an exemplary embodiment, taken in conjunction with the accompanying drawings.

DESCRIPTION OF THE EMBODIMENTS

Figure 1:
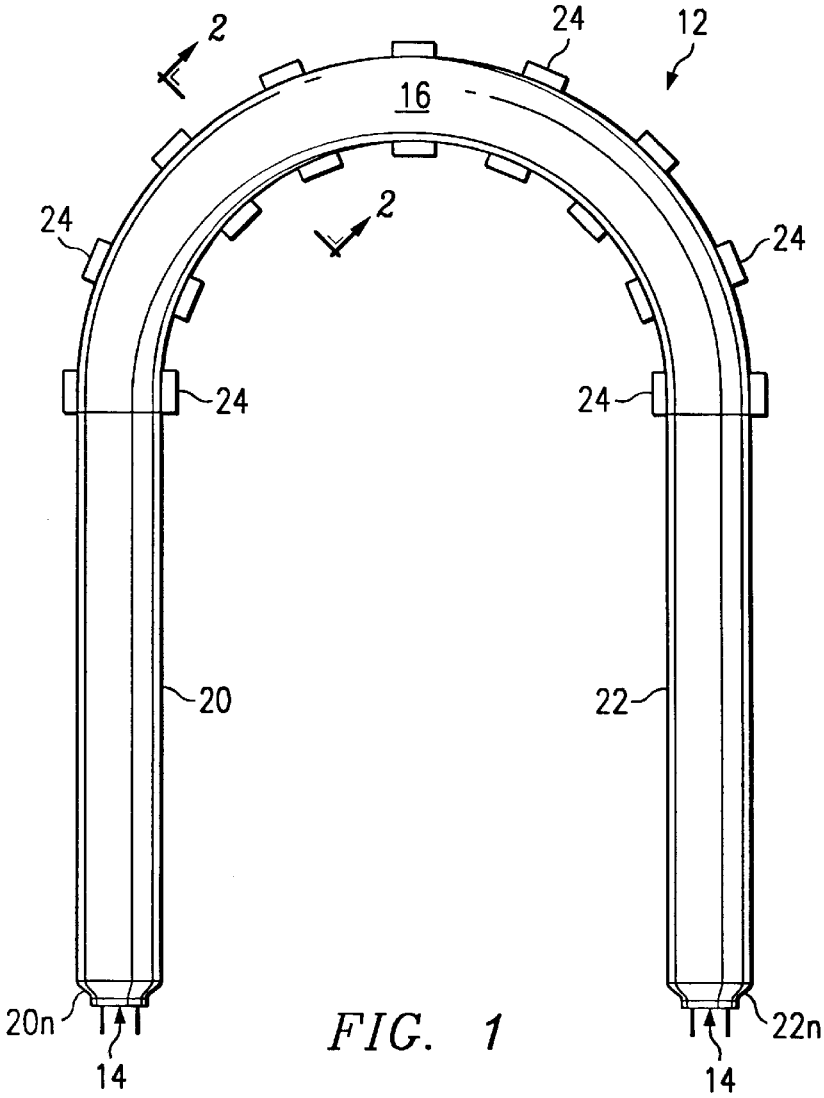
FIG. 1 is a top plan view of the embodiment.
Figure 2:
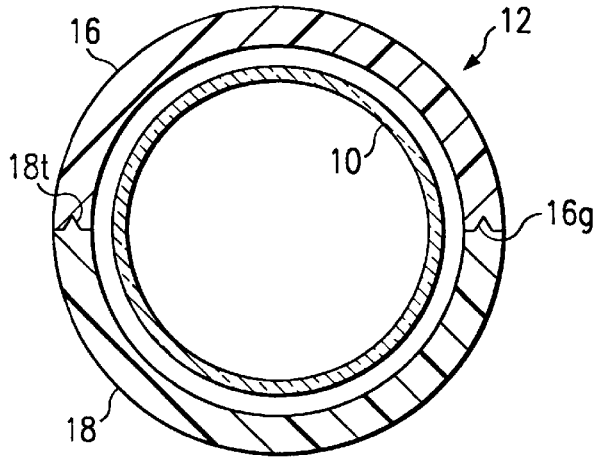
FIG. 2 is a transverse cross-sectional view taken along the lines 2—2 of FIG. 1.
Figure 4:
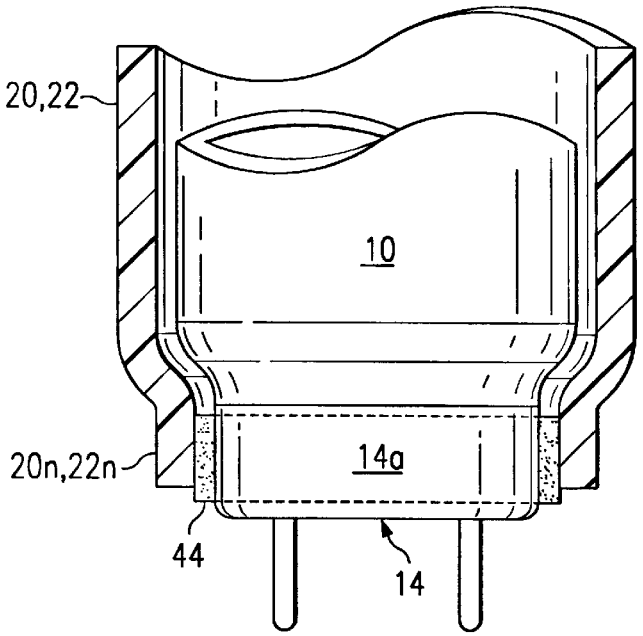
FIG. 4 is a detail transverse cross-sectional view taken diametrically at the joint between one of the straight tubes and the terminal end cap of the lamp.

FIG. 1, which is generally schematic in form and not to scale, shows a plan view of the embodiment, which consists of a U-shaped fluorescent lamp 10 of conventional construction (not visible in FIG. 1 but shown in part in FIGS. 2 and 4) and a protective assembly 12, which encloses the entire lamp except for a small exposed end portion of the terminal end caps 14 at each end of the lamp 10 (FIG. 4). As is well known, the lamp 10 has a glass tube that includes a loop portion and a pair of straight leg portions integral with the loop portion.

The protective assembly 12 consists of four parts—an upper loop part 16; a lower loop part 18; a left straight part 20; and a right straight part 22. Each of the loop parts 16 and 18 is made by injection molding. Each of the straight parts 20 and 22 is a piece cut to the desired length from an extruded tube. All of the parts are made from transparent or translucent polycarbonate resins that are compounded to make them highly transparent to visible light but substantially opaque to UV radiation having wavelengths of up to 390 NM. The compounds do not turn yellow with age to any significant extent. The resin compound for the injection-molded parts differs from that of the extruded straight parts, as is known to those skilled in the art, by virtue of the different forming processes. The resin compound of the loop parts is also formulated to be more rigid than the straight parts in order to be dimensionally stable and hold the joints tight. The straight parts are semi-rigid, which enables them to absorb energy when impacted and permits moderate elastic expansion at the telescopic joints with the loop unit 16/18, as described below.

Figure 5:
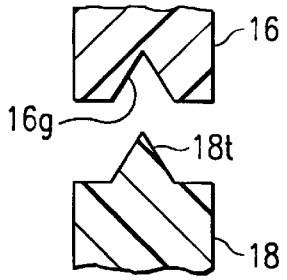
FIG. 5 is a detail end cross-sectional view, showing the joint between the two parts of the loop unit.

Each loop part 16 and 18 is U-shaped in plan and semi-cylindrical in cross-section. Each is configured so that when the two parts are mated at joints in the diametrical center plane of the lamp, the inner surface of the loop unit 16/18 is in close clearance from the external surface of the glass tube of the lamp, thereby ensuring good heat transfer from the lamp and through the loop unit to the ambient air. The joint between the loop parts 16 and 18 is a tongue and groove joint (see FIGS. 2 and 5), the upper part 16 having a groove 16*g* and the lower part 18 having a tongue 18*t*. The tongue and groove joint helps stabilize the joint by holding the parts against relative displacement in the plane of the joint and provides a good seal for containment of constituents of the lamp, especially phosphor powders and mercury, in the event that the lamp should break. As further assurance of stability and sealing of the joint of the loop unit 16/18, it is possible to include an adhesive, chemical, or fusion bond at the joint between the parts of the loop unit.

Figure 6:
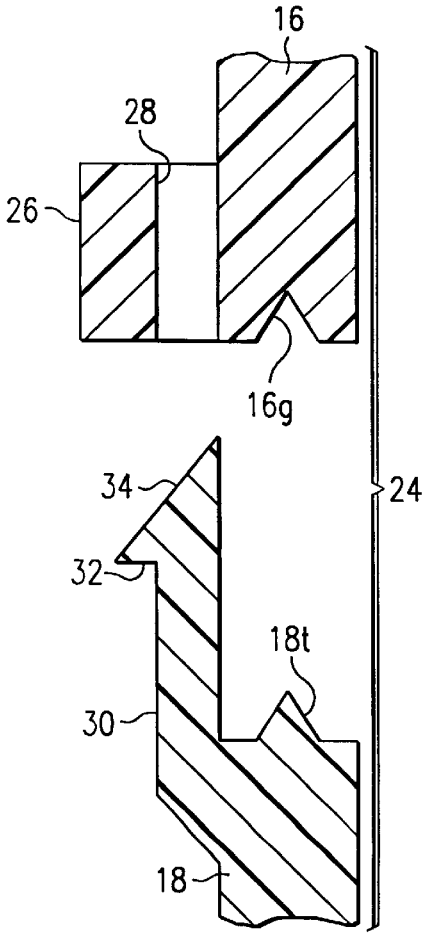
FIG. 6 is a detail end cross-sectional view of one of the snap-fit couplings by which the two parts of the loop unit are joined.

It is preferred, according to the invention, to join the loop parts 16 and 18 at the joint by mechanical couplings. The embodiment has mechanical couplings in the form of snap-fit couplings 24, there being several, say 10, along each edge of the loop unit at equal angular spacing from each other. As shown in FIG. 6, each coupling 24 includes a lug 26 projecting from the edge of the upper loop part 16, the lug having a slot 28, and a hook 30 projecting up from the side edge of the lower loop part 18. When assembled, the hook 30 passes through the slot 28, and a shoulder 32 on the head portion 34 of the hook 30 engages a portion of the upper surface of the lug 26 adjacent the slot 28. A suitable number of snap-fit couplings at a suitable spacing from each other securely holds the two loop parts 16 and 18 together at a stable and sealed joint. The loop parts 16 and 18 are, of course, applied to the lamp and then joined by pressing them together to set the snap-fit couplings 24.

Figure 3:
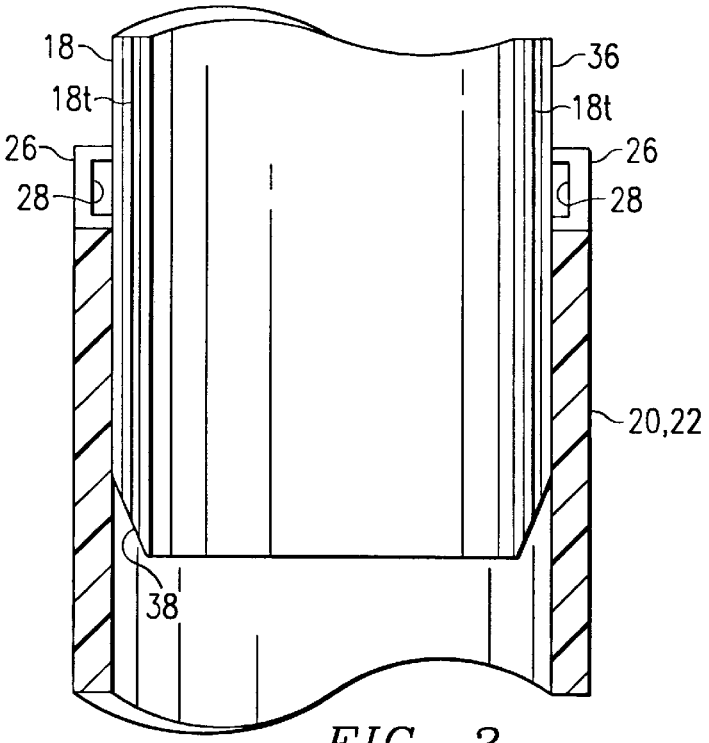
FIG. 3 is a detail top cross-sectional view taken diametrically at the joint between the loop unit and one of the tubes.

After the loop unit 16/18 is assembled to the lamp, the straight tubes 20 and 22 are slid along the straight parts of the lamp and joined to the ends of the loop unit. To that end, the loop unit parts are molded to form end portions 36 of the loop unit that are shaped and dimensioned to be received telescopically within the end portions of the respective straight tubes 20, 22 (see FIG. 3). The straight tubes are, as mentioned above, semi-rigid and thus can be elastically deformed. The end portion of each tube is elastically expanded upon being pushed onto the end portion 36 of the loop unit. The elastic expansion creates an interference fit, which is strong enough to keep the loop unit from separating from the straight tubes in the event that the lamp should break. If desired, the joints between the loop unit and the straight tubes can be augmented by an adhesive, chemical or fusion bond. Assembly may be facilitated by having the outer surface of the end portion 36 of the loop unit tapered, by providing a beveled end 38 on the end to guide the straight tube unto the end portion, or having both a taper and a beveled end. The telescopic joint may be from about one-half inch to about one inch long. The desired length of the telescoping joint may be established by having the endmost lugs 26 serve as stops for the straight tubes, as shown in FIG. 3. (Note that FIG. 3 shows wall thicknesses proportionately to the diameters much larger than actual and also does not show the expansion of the straight tube at the overlap, relative to the unexpanded part.)

After the straight tubes 20 and 22 are pushed into place (FIG. 3), the free ends are joined to the peripheral flange portions 14*a* of terminal end caps 14 of the lamp 10. Before placing the tubes 20 and 22 over the straight parts of the lamp, two wraps of a double-faced contact adhesive tape 44 were applied to the flanges 14*a*. After the tubes 20, 22 are in place, the ends are heated to soften them and mechanically deformed to produce a necked down end portion 20*n*, 22*n* of the tube 20, 22 and to engage the necked down portion with the adhesive to form a bond. In practice, it .has been found that the easiest, most reliable way to mechanically compress the end portion 20*n*, 22*n* of the tubes is to apply a collar of a heat shrinkable plastic over the end portion of the tube 20, 22 and heat the collar with a hot air blower. Shrinking of the collar mechanically compresses the tube to form the adhesive bond. After the bond is formed, the collar is cut off and discarded.

Other ways of securing the tubes 20, 22 to the end caps 14 of the lamp are possible. For example, a spacer/seal can be inserted into the gap between the tube and the lamp end cap flange 14*a* and an adhesive, such as a hot melt adhesive, forced into the gap.

What is claimed is:

1. A U-shaped fluorescent lamp with a protective assembly comprising a U-shaped fluorescent lamp having a glass tube that includes a loop portion and a pair of straight leg portions integral with the loop portion and a terminal end cap joined to a free end of each leg portion; and a protective assembly having a loop unit and a pair of leg units, the loop unit being composed of a pair of loop parts, each loop part being formed of a transparent or translucent non-frangible polymeric material and being semi-cylindrical in cross section and shaped in plan to match the shape in plan of the loop portion of the glass tube, the loop parts being coextensive and engaging each other along mating edges and being joined to each other along the edges; and each leg unit being a straight one-piece tube of a transparent or translucent non-frangible polymeric material and being cylindrical in cross-section, each tube being substantially coextensive with one of the straight portions of the lamp and being joined at one end to one end of the loop unit and at the other end to the terminal end cap of the lamp.

2. The U-shaped fluorescent lamp according to claim 1 wherein the edges of the loop parts are joined to each other by mechanical couplings.

3. The U-shaped fluorescent lamp according to claim 2 wherein the mechanical couplings are snap-fit couplings.

4. The U-shaped fluorescent lamp according to claim 3 wherein each snap-fit coupling includes a lug on one loop part, the lug having a slot, and a hook on the other loop part, the hook being received through the slot and having a shoulder engaged in capturing relation with a portion of the lug adjacent the slot.

5. The U-shaped fluorescent lamp according to claim 1 wherein each straight tube is joined to the loop unit by a telescopic joint between an end portion of the loop unit that is cylindrical in cross section and an end portion of the straight tube.

6. The U-shaped fluorescent lamp according to claim 5 wherein the end portion of the straight tube telescopically receives the end portion of the loop unit.

7. The U-shaped fluorescent lamp according to claim 6 wherein the telescopic joint is formed solely by an interference fit between the end portion of the straight tube and the end portion of the loop unit.

8. The U-shaped fluorescent lamp according to claim 7 wherein the end portion of the loop unit has a tapered external surface to facilitate reception of the end portion of the straight tube.

9. The U-shaped fluorescent lamp according to claim 7 wherein the end portion of the loop unit has a beveled end surface to facilitate reception of the end portion of the tube.

10. The U-shaped fluorescent lamp according to claim 1 wherein the mating edges of the loop parts interfit by a tongue and groove.

11. The U-shaped fluorescent lamp according to claim 1 wherein the free end of each straight tube is joined to the terminal end cap of the lamp by an adhesive bond between a necked down end portion of the straight tube and the terminal end cap, the necked down portion being formed by heating and mechanically compressing the end portion in situ.

12. The U-shaped fluorescent lamp according to claim 11 wherein the adhesive bond is provided by a length of double-faced adhesive tape wrapped around the terminal end cap of the lamp before the straight tube is placed over the lamp.

13. A U-shaped fluorescent lamp with a protective assembly comprising a U-shaped fluorescent lamp having a glass tube that includes a loop portion and a pair of straight leg portions integral with the loop portion and a terminal end cap joined to a free end of each leg portion; and a protective assembly having a loop unit and a pair of leg units, the loop unit being composed of a pair of loop parts, each loop part being formed of a transparent or translucent non-frangible polymeric material and being semi-cylindrical in cross section and shaped in plan to match the shape in plan of the loop portion of the glass tube, the loop parts being coextensive and engaging each other along mating edges and being joined to each other along the edges solely by mechanical couplings; and each leg unit being a straight one-piece tube of a transparent or translucent non-frangible polymeric material and being cylindrical in cross section, each tube being substantially coextensive with one of the straight portions of the lamp and being joined at one end to one end of the loop unit by a telescopic joint in which the end portion of the straight tube receives a cylindrical end portion of the loop unit and being joined at the other end to the terminal end cap of the lamp.

14. The U-shaped fluorescent lamp according to claim 13 wherein the mechanical couplings are snap-fit couplings.

15. The U-shaped fluorescent lamp according to claim 14 wherein each snap-fit coupling includes a lug on one loop part, the lug having a slot, and a hook on the other loop part, the hook being received through the slot and having a shoulder engaged in capturing relation with a portion of the lug adjacent the slot.

16. The U-shaped fluorescent lamp according to claim 13 wherein the telescopic joint is formed solely by an interference fit between the end portion of the straight tube and the end portion of the loop unit.

17. The U-shaped fluorescent lamp according to claim 16 wherein the end portion of the loop unit has a tapered external surface to facilitate reception of the end portion of the straight tube.

18. The U-shaped fluorescent lamp according to claim 16 wherein the end portion of the loop unit has a beveled end surface to facilitate reception of the end portion of the tube.

19. The U-shaped fluorescent lamp according to claim 13 wherein the mating edges of the loop parts interfit by a tongue and groove.

20. The U-shaped fluorescent lamp according to claim 13 wherein the free end of each straight tube is joined to the terminal end cap of the lamp by an adhesive bond between a necked down end portion of the straight tube and the terminal end cap, the necked down portion being formed by heating and mechanically compressing the end portion in situ.

* * * * *